US008689419B2

(12) United States Patent
Lin

(10) Patent No.: US 8,689,419 B2
(45) Date of Patent: Apr. 8, 2014

(54) MULTI-STEP CONTROL RIVET GUN

(75) Inventor: Yu-Ching Lin, New Taipei (TW)

(73) Assignee: Yu-Ching Lin, New Taipei (TW)

( * ) Notice: Subject to any disclaimer, the term of this patent is extended or adjusted under 35 U.S.C. 154(b) by 182 days.

(21) Appl. No.: 13/425,988

(22) Filed: Mar. 21, 2012

(65) Prior Publication Data

US 2013/0247346 A1 Sep. 26, 2013

(51) Int. Cl.
*B21J 15/10* (2006.01)
*B21J 15/22* (2006.01)

(52) U.S. Cl.
USPC ..... 29/243.525; 72/391.4; 29/243.524

(58) Field of Classification Search
USPC ..... 72/391.4, 391.6, 391.8; 29/243.523, 29/243.524, 243.525, 243.526
See application file for complete search history.

(56) References Cited

U.S. PATENT DOCUMENTS

| | | | | |
|---|---|---|---|---|
| 5,742,989 | A * | 4/1998 | Subotsch | 29/243.525 |
| 6,978,526 | B1 * | 12/2005 | Lin | 29/243.525 |
| 7,082,658 | B1 * | 8/2006 | Lin | 29/243.525 |
| 8,091,195 | B2 * | 1/2012 | Lin | 29/243.525 |
| 8,468,669 | B1 * | 6/2013 | Lin | 29/243.525 |

* cited by examiner

*Primary Examiner* — David B Jones
(74) *Attorney, Agent, or Firm* — Tracy M. Heims; Apex Juris, pllc

(57) ABSTRACT

A rivet gun has a barrel, a handle, a pneumatic cylinder and a two-step pressing assembly. The handle has a valve-mounting hole, a first mounting hole and a second mounting hole being cylindrical and defined in a bottom end of the handle. The pneumatic cylinder has an inlet bushing, an inner bushing and a control valve assembly respectively mounted in the aforementioned holes. The two-step pressing assembly is mounted on the handle and allows the rivet gun to be operated by two steps. The handle is structurally simple and has a low manufacturing cost. The bushings and control valve assembly are easily mounted in and detached from the handle so that assembling of the rivet gun is efficient.

8 Claims, 21 Drawing Sheets

MULTI-STEP CONTROL RIVET GUN

BACKGROUND OF THE INVENTION

1. Field of the Invention

The present invention relates to a rivet gun, and more particularly to a multi-step control rivet gun that may be pulled and triggered in two steps. Pulling the trigger device to a first step activates the high-pressure airflow through the rivet gun to eject and discard a remaining core pin of a used rivet out of the rivet gun. Further pressing the trigger device to a second step stops the airflow and drives the rivet gun to pull a core pin of an unused rivet on the front end of the barrel of the rivet gun to finish a riveting operation. Furthermore, the handle is easily manufactured and assembled to lower its cost.

2. Description of Related Art

Conventional rivet guns are used for mounting rivets on at least two pieces so that the rivets securely hold the pieces together. A rivet has a cap and a core pin. The cap is T-shaped and has an enlarged end and a mounting end. The core pin is mounted longitudinally through, protrudes out of the cap and has two ends and a ball formed on one end and adjacent to the mounting end of the cap.

A conventional rivet gun comprises a barrel, a handle, a trigger, a pin collector and a valve member.

The barrel has a front end, a rear end and a vise assembly that may vise and pull a core pin of a rivet on the front end into the barrel. The handle is mounted perpendicularly on the barrel and has air passageways. The collector is a jar mounted on the rear end of the barrel to collect the ejected core pins. The pneumatic cylinder is mounted movably under the handle and capable of activating the vise assembly through pneumatic and hydraulic means. Furthermore, the pneumatic cylinder may be connected to a high-pressure air source such as an air bottle to implement the ejection of the core pin.

When the rivet gun is used to rivet two pieces such as boards or plates together, a rivet is mounted through the pieces. The enlarged end of the cap of the rivet abuts an inside piece and the front end of the barrel of the rivet gun abuts the enlarged end. The trigger is pulled to activate the vise assembly to pull a core pin on the cap into the barrel. The ball on the core pin longitudinally compresses and radially expands the mounting end of the cap into T-shape so that the expanded mounting end hooks on an outside piece to complete the riveting process. Then, the air output by the high-pressure air source flows through the barrel from the front end to the rear end and sucks the broken core pin vised by the vise assembly backward into the collector.

However, when the external high-pressure air source is connected to the rivet gun, the high-pressure air source constantly outputs air into the rivet gun no matter whether the rivet gun is triggered or not. The high-pressure air source cannot selectively output air when the broken core pin is ejected, and cannot stop outputting during the vise assembly's vising and pulling the core pin.

Furthermore, the structure of the rivet gun is complicated so that forming a housing thereof by insert-molding processes easily fails and the manufacturing cost of the rivet gun is therefore high.

To overcome the shortcomings, the present invention provides a multi-step control rivet gun to mitigate or obviate the aforementioned problems.

SUMMARY OF THE INVENTION

The main objective of the invention is to provide a multi-step control rivet gun that may be pulled and triggered in two steps. Pulling the trigger device to a first step activates the high-pressure airflow through the rivet gun to eject and discard a remaining core pin of a used rivet out of the rivet gun. Further pressing the trigger device to a second step stops the airflow and drives the rivet gun to pull a core pin of an unused rivet on the front end of the barrel of the rivet gun to finish a riveting operation. Furthermore, the handle is easily manufactured and assembled to lower its cost.

A rivet gun has a barrel, a handle, a pneumatic cylinder and a two-step pressing assembly. The handle has a valve-mounting hole, a first mounting hole and a second mounting hole being cylindrical and defined in a bottom end of the handle. The pneumatic cylinder has an inlet bushing, an inner bushing and a control valve assembly respectively mounted in the aforementioned holes. The two-step pressing assembly is mounted on the handle and allows the rivet gun to be operated by two steps. The handle is structurally simple and has a low manufacturing cost. The bushings and control valve assembly are easily mounted in and detached from the handle so that assembling of the rivet gun is efficient.

Other objectives, advantages and novel features of the invention will become more apparent from the following detailed description when taken in conjunction with the accompanying drawings.

DETAILED DESCRIPTION OF THE PREFERRED EMBODIMENT

Figure 1A:
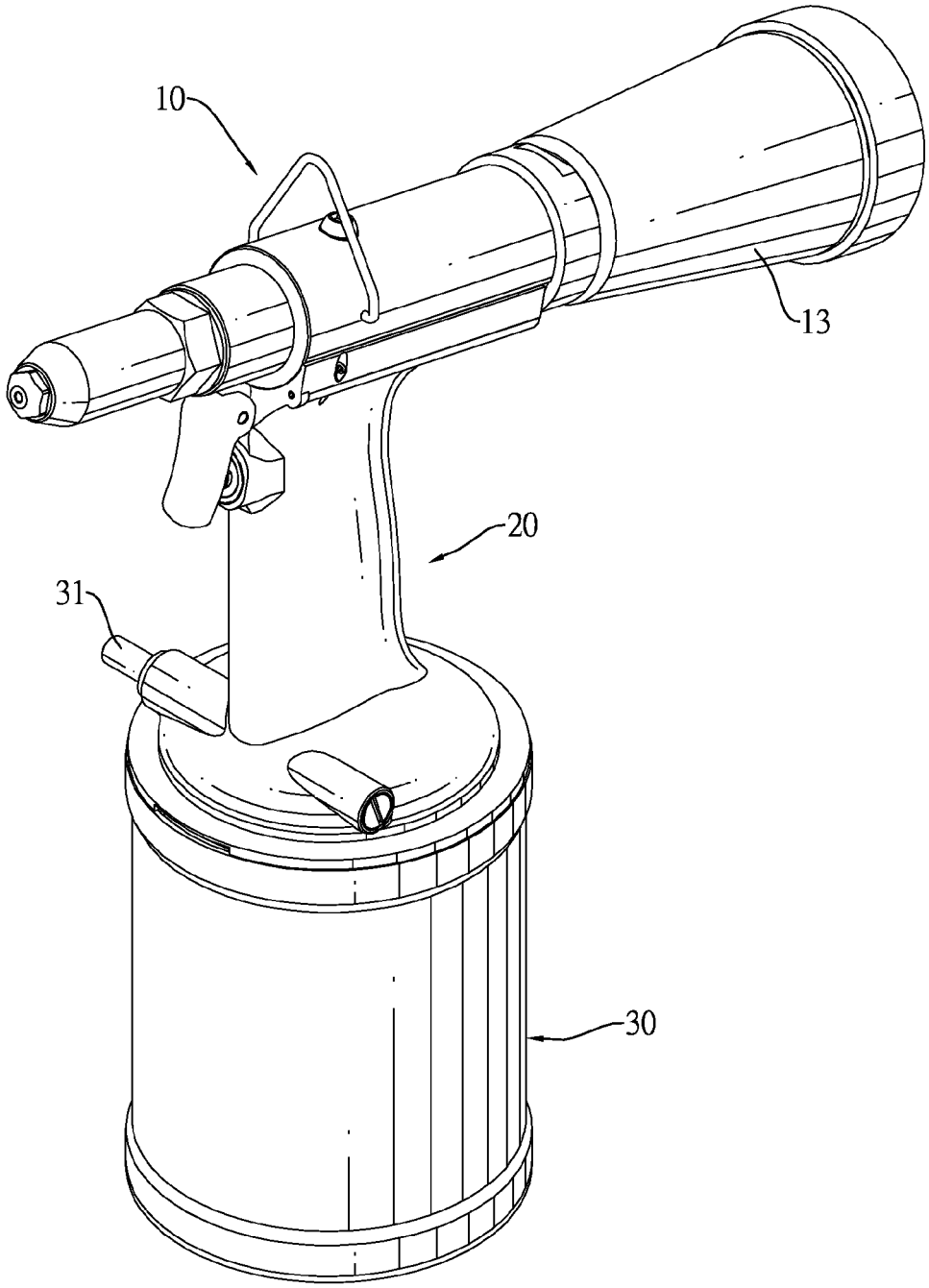
FIG. 1A is a perspective view of a rivet gun device in accordance with the present invention.
Figure 1B:
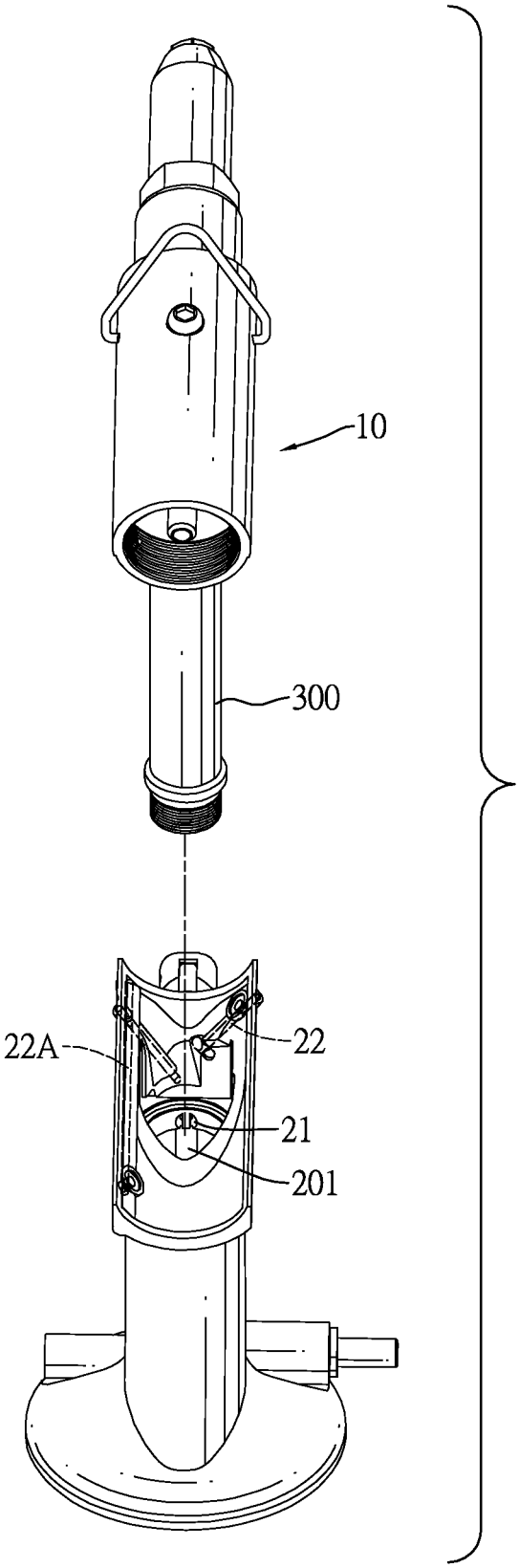
FIG. 1B is a partially exploded perspective view of the barrel and handle of the rivet gun in FIG. 1A.
Figure 1C:
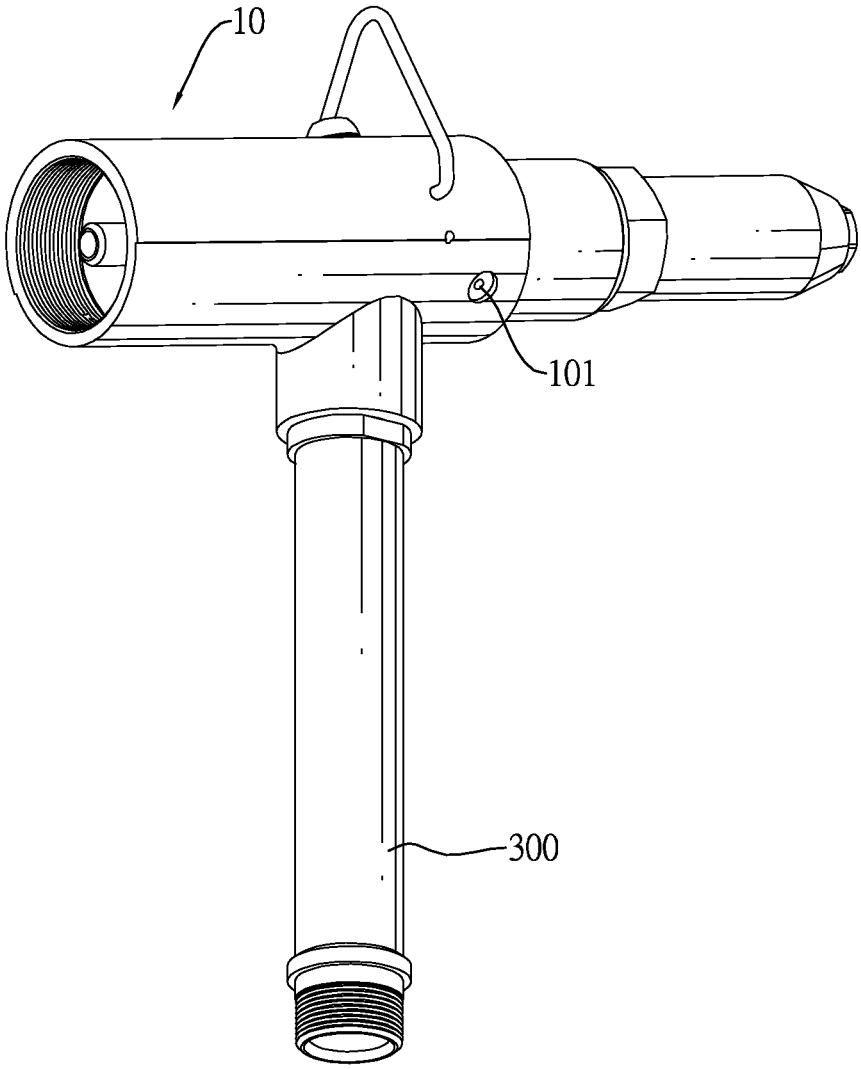
FIG. 1C is a perspective view of the barrel of the rivet gun in FIG. 1A.
Figure 1D:
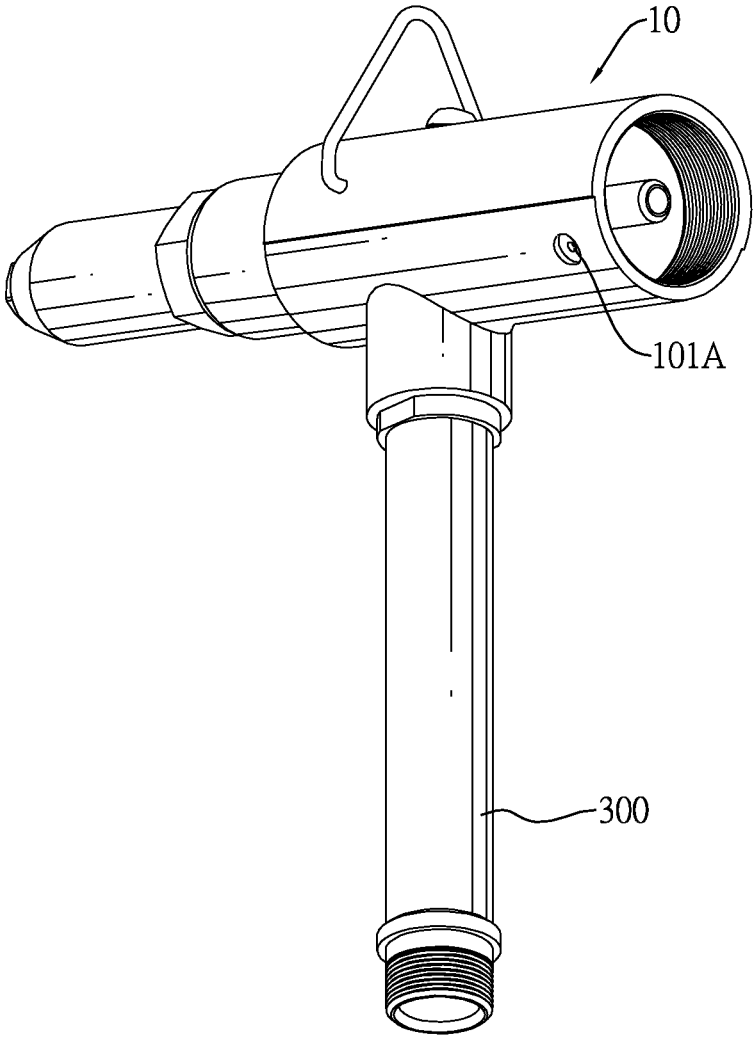
FIG. 1D is another perspective view of the barrel of the rivet gun in FIG. 1A.
Figure 1E:
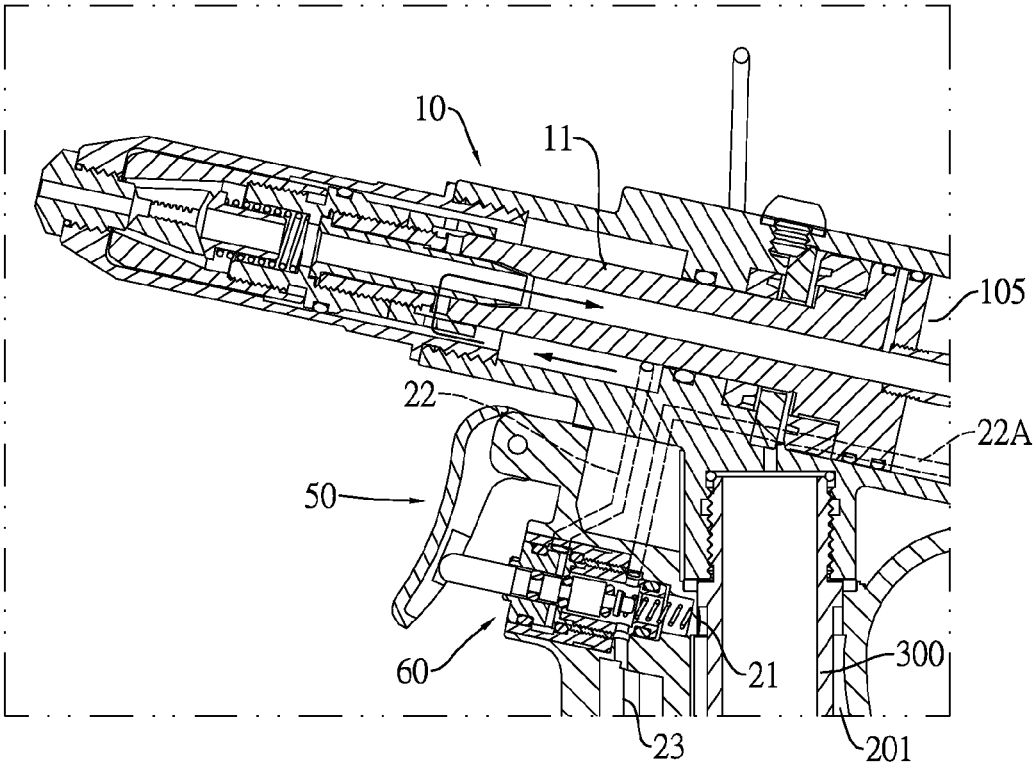
FIG. 1E is a cross sectional side view of the barrel of the rivet gun in FIG. 1A.
Figure 1F:
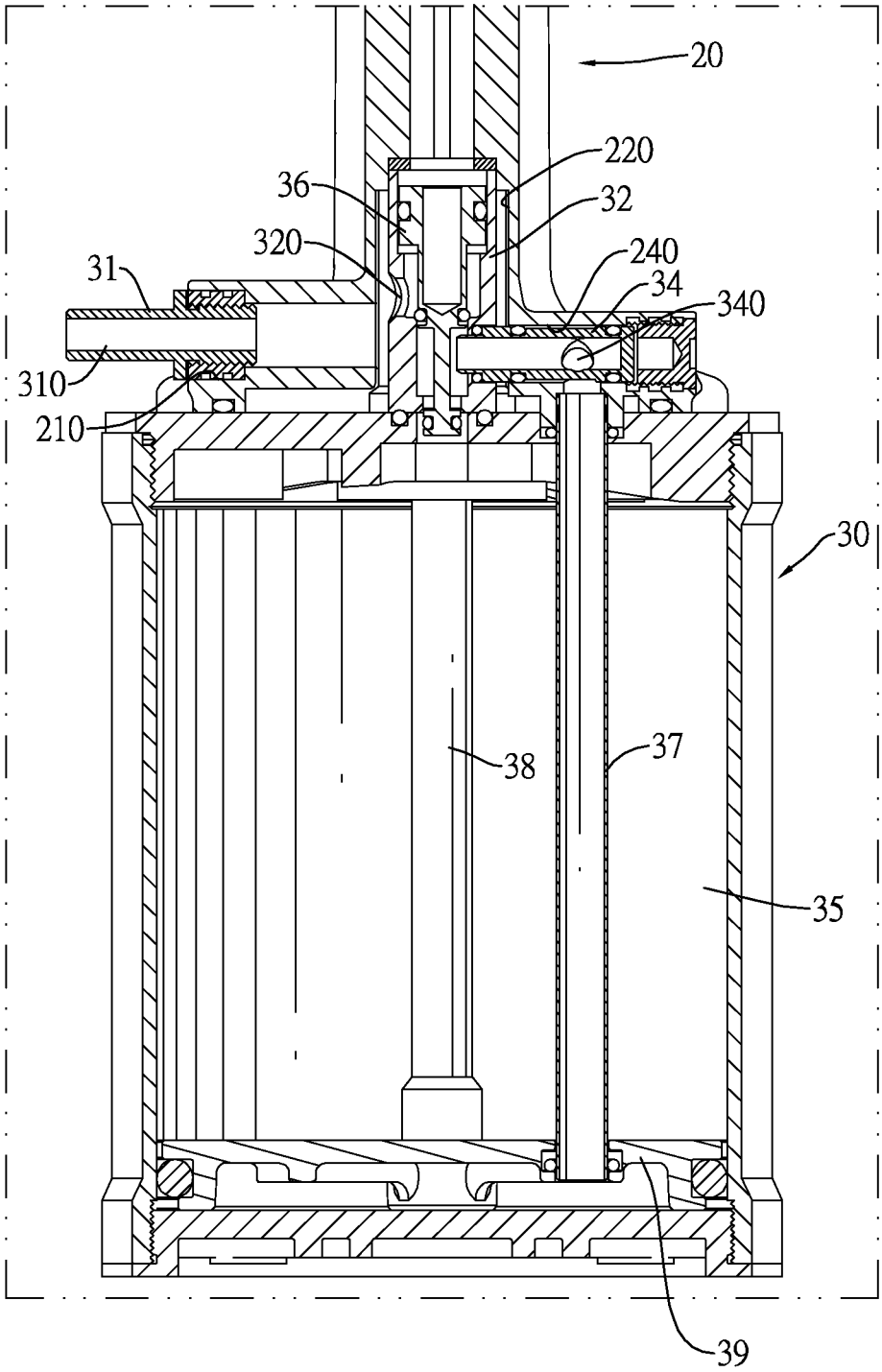
FIG. 1F is a cross sectional front view of the pneumatic cylinder of the rivet gun in FIG. 1A.

With reference to FIGS. 1A to 1F and 2A, a rivet gun in accordance with the present invention is able to rivet pieces together through a rivet that has a cap and a core pin. The cap is T-shaped and has an enlarged end and a mounting end. The core pin is mounted longitudinally through, protrudes out of the cap and has two ends and a ball formed on one end and adjacent to the mounting end of the cap.

With further reference to FIGS. 2A to 2D, the rivet gun in accordance with the present invention comprises a barrel (10), a handle (20), a pneumatic cylinder (30), a trigger member (50) and a two-step pressing assembly (60).

The barrel (10) is hollow and has a through hole, an outlet hole (101), a pressurizing hole (101A), a hydraulic passageway (103), a vise assembly (11), a condensable chamber (105) and a collector (13).

The through hole is defined axially through the barrel (10).

The outlet hole (101) is defined transversely through the barrel (10) and communicates with the through hole.

The pressurizing hole (101A) is defined transversely through the barrel (10), is located behind the outlet hole (101) and communicates with the through hole.

The hydraulic passageway (103) is defined through the bottom of the barrel (10) and communicates with the through hole.

The vise assembly (11) is mounted in the through hole and has a front end, a rear end, a bottom, two vises and a tube. The vises are mounted on the front end. The tube is mounted on the rear end and has multiple transverse holes (as shown by an airflow arrow in FIG. 1E) defined radially through the tube.

The condensable chamber (105) is defined in the barrel (10) and is located behind the rear end of the vise assembly (11).

The collector (13) is a jar, is mounted on the rear end of the barrel (10) and may receive core pins pulled and separated from used rivets.

Figure 2A:
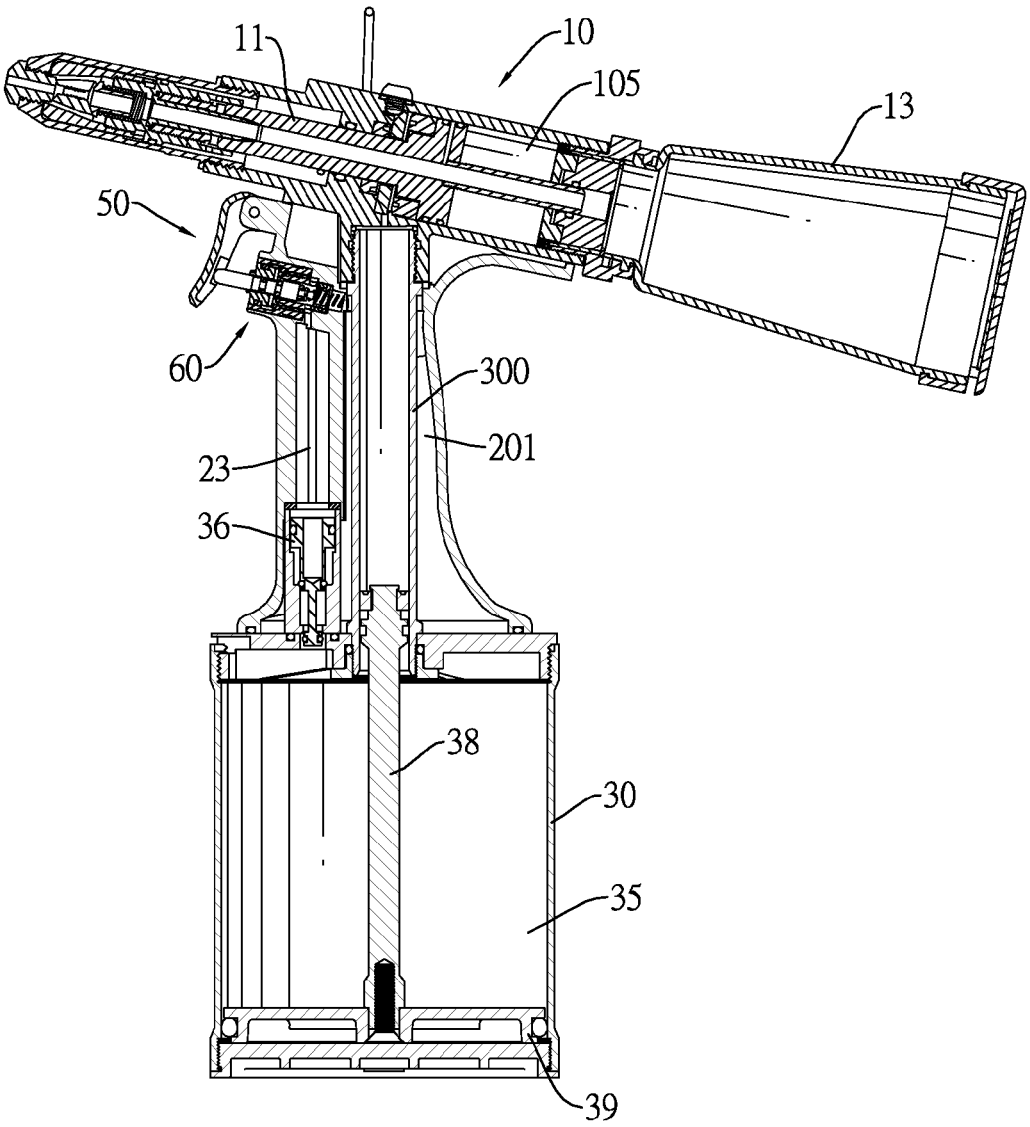
FIG. 2A is a cross sectional side view of the rivet gun in FIG. 1, wherein the trigger device is not triggered.
Figure 2B:
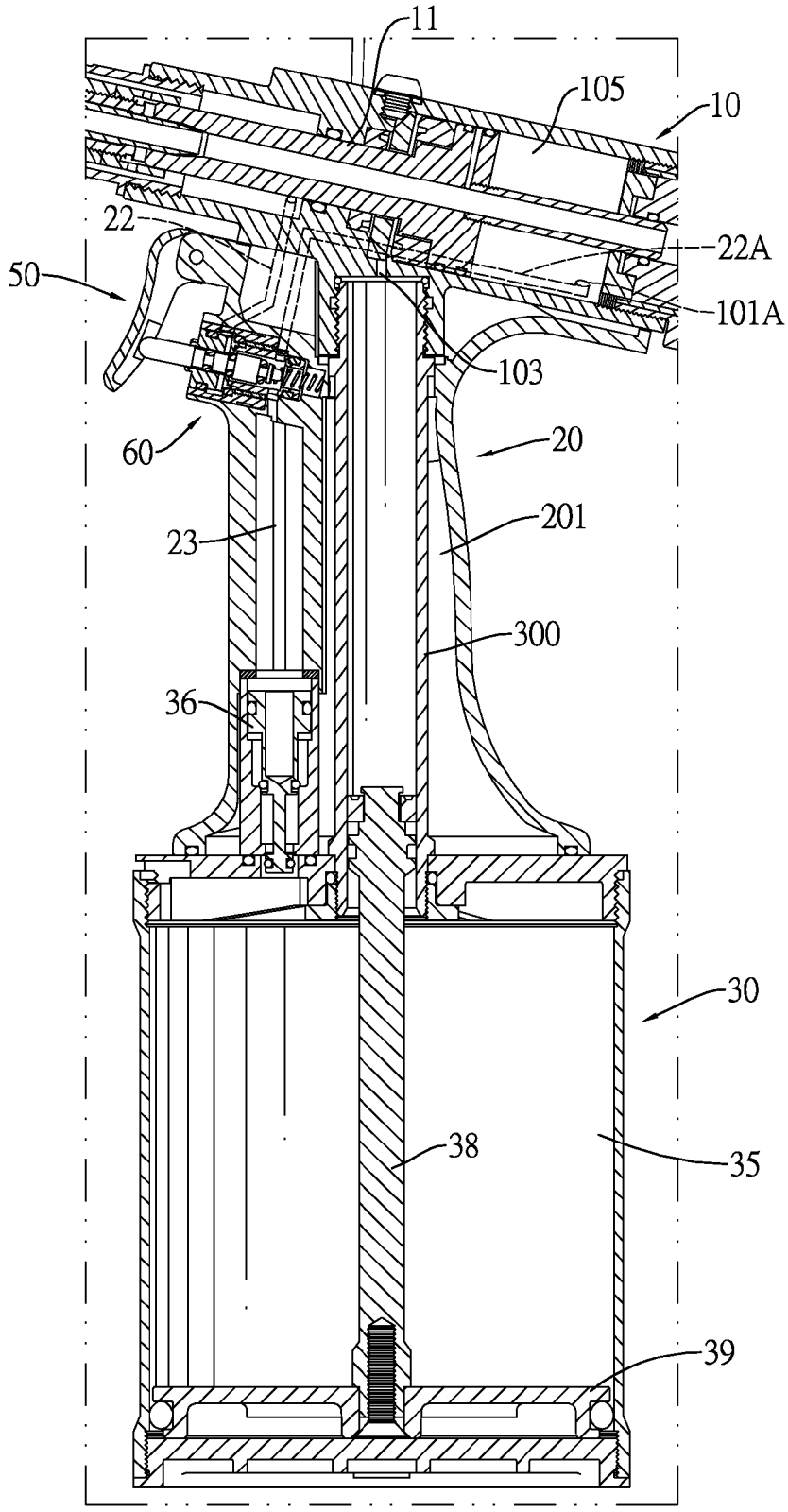
FIG. 2B is an enlarged cross sectional side view of the rivet gun in FIG. 2A.
Figure 2C:
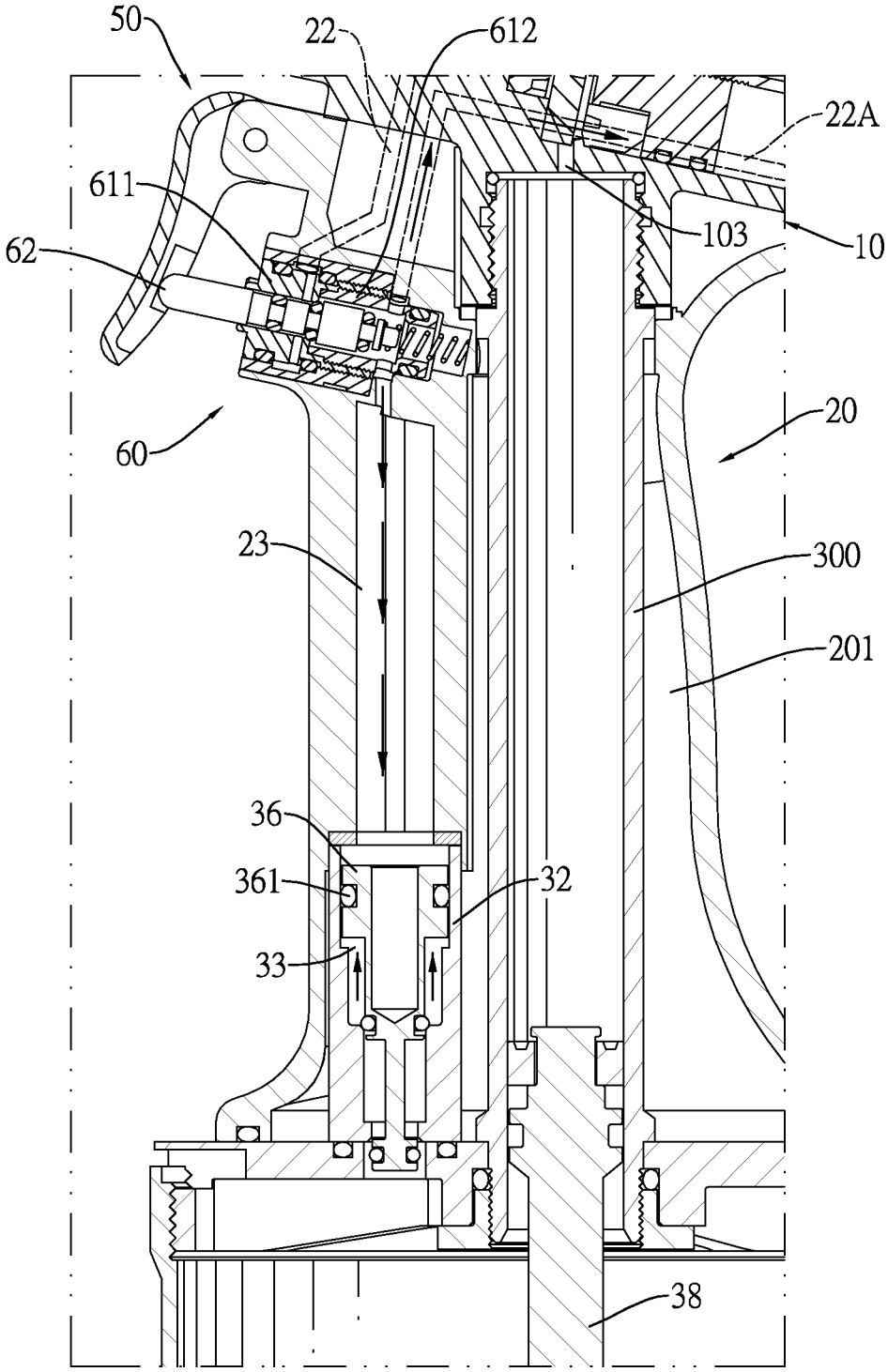
FIG. 2C is a further enlarged cross sectional side view aimed at the handle of the rivet gun in FIG. 2B.
Figure 2D:
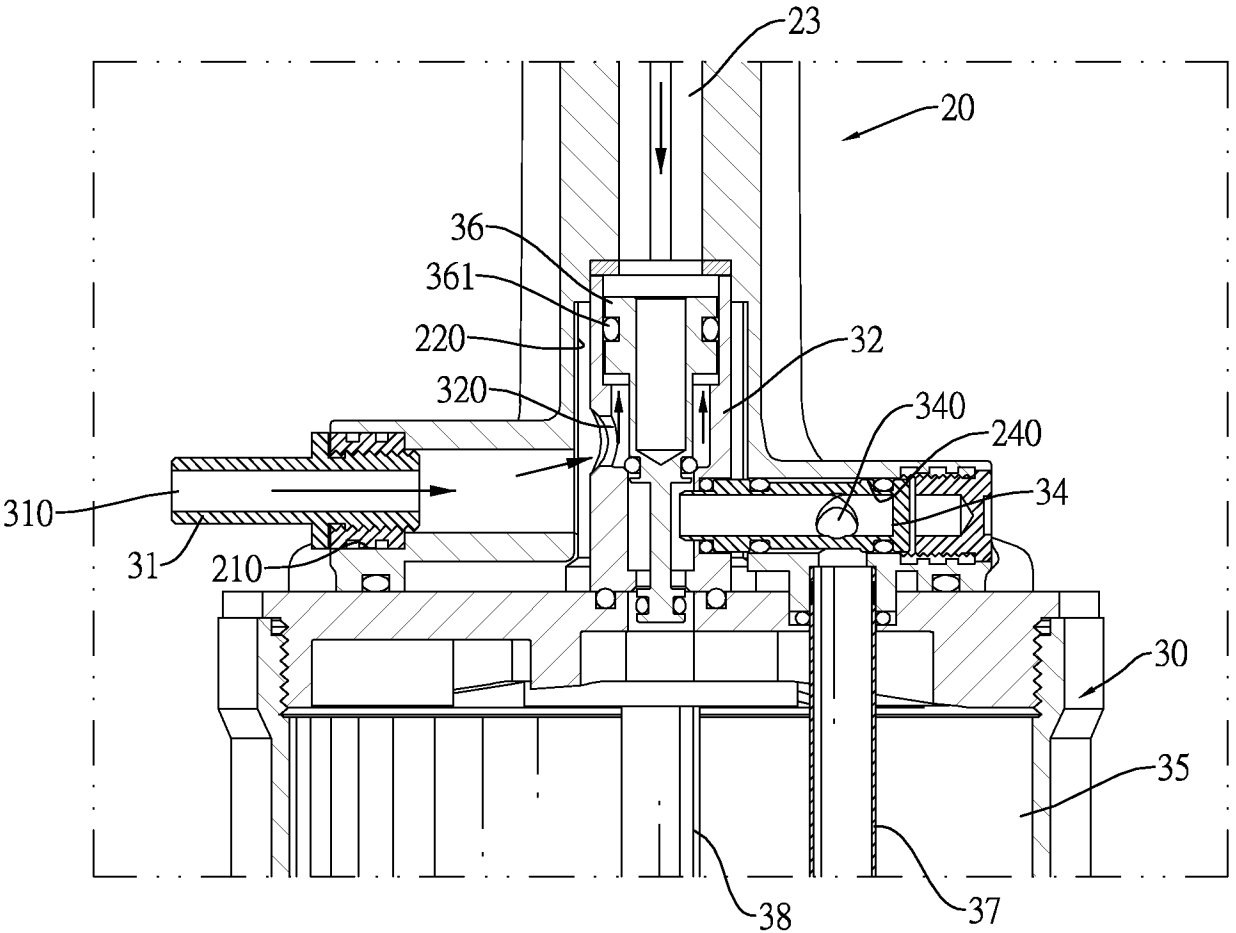
FIG. 2D is a further enlarged cross sectional front view aimed at the bottom of the handle and the top of the pneumatic cylinder of the rivet gun in FIG. 2B.
Figure 2E:
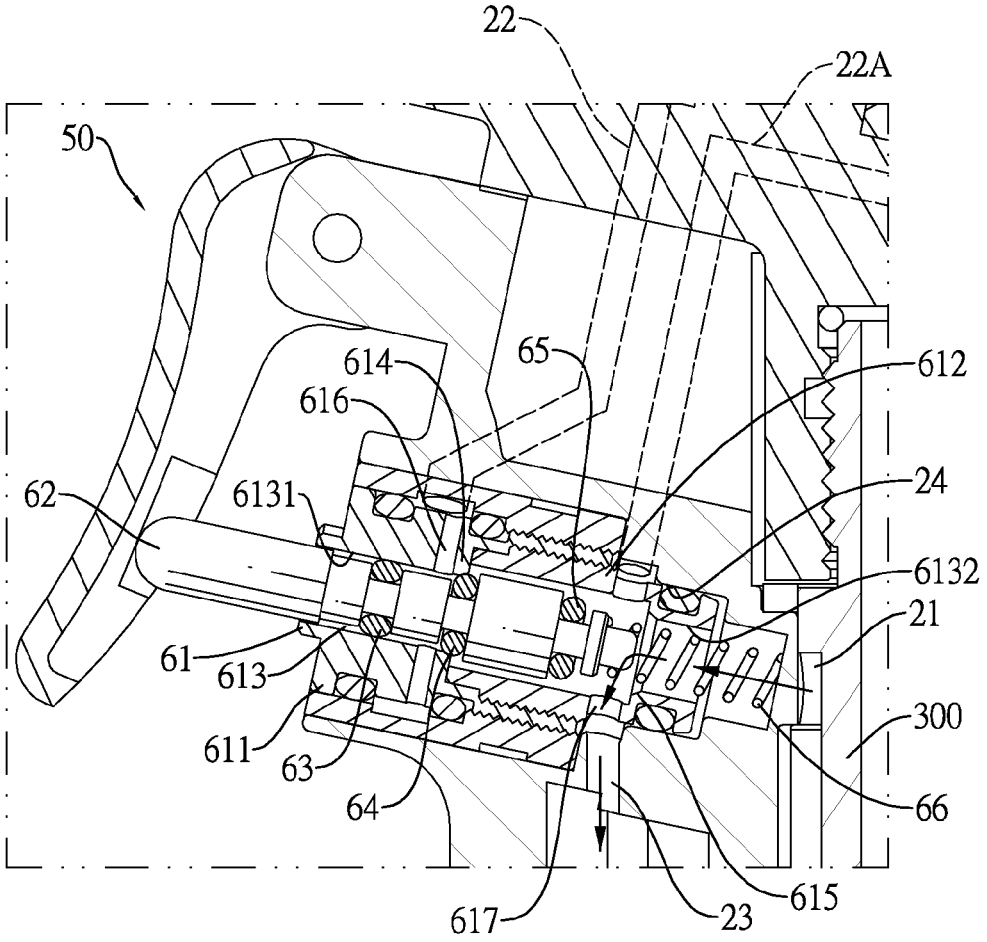
FIG. 2E is a further enlarged cross sectional side view further aimed at the trigger device of the rivet gun in FIG. 2D.
Figure 3A:
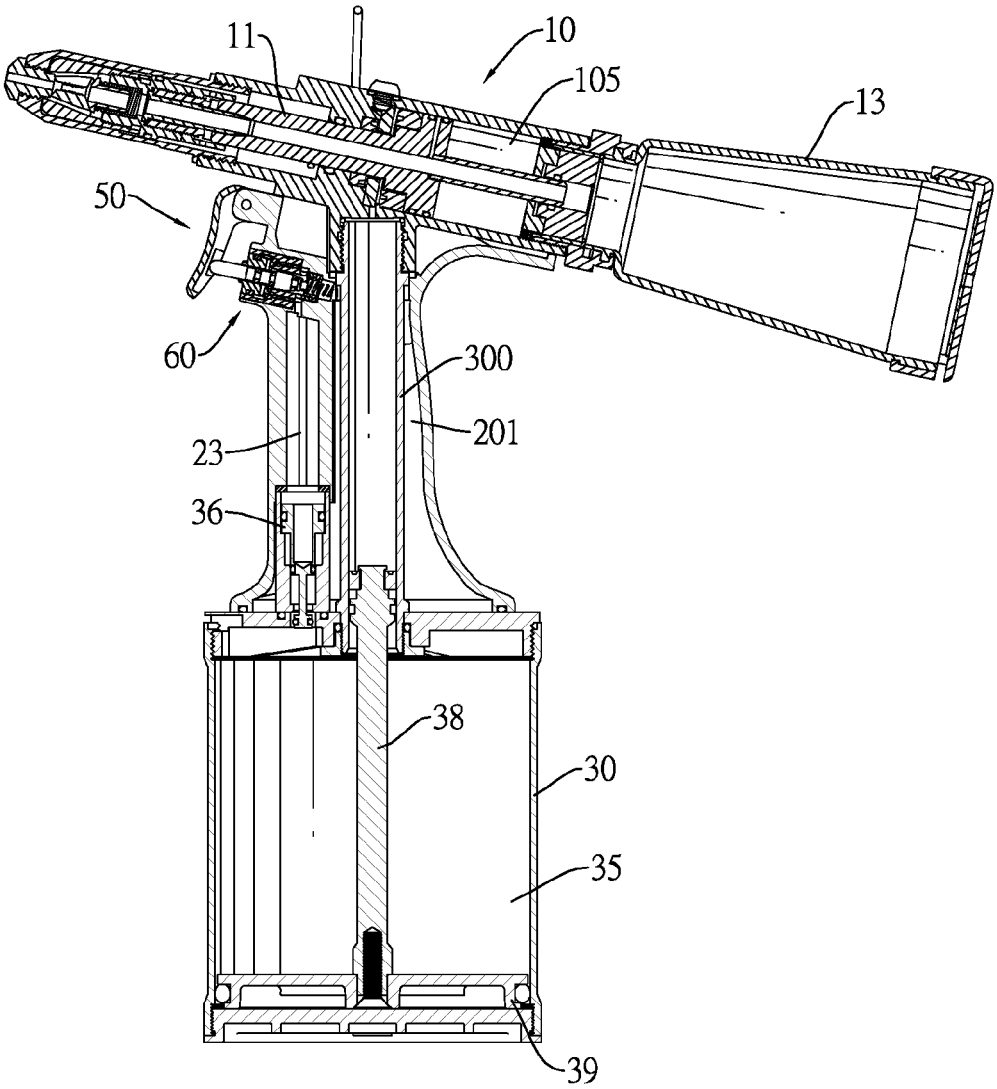
FIG. 3A is a cross sectional side view of the rivet gun in FIG. 1A, wherein the trigger device is triggered to a first step.
Figure 3B:
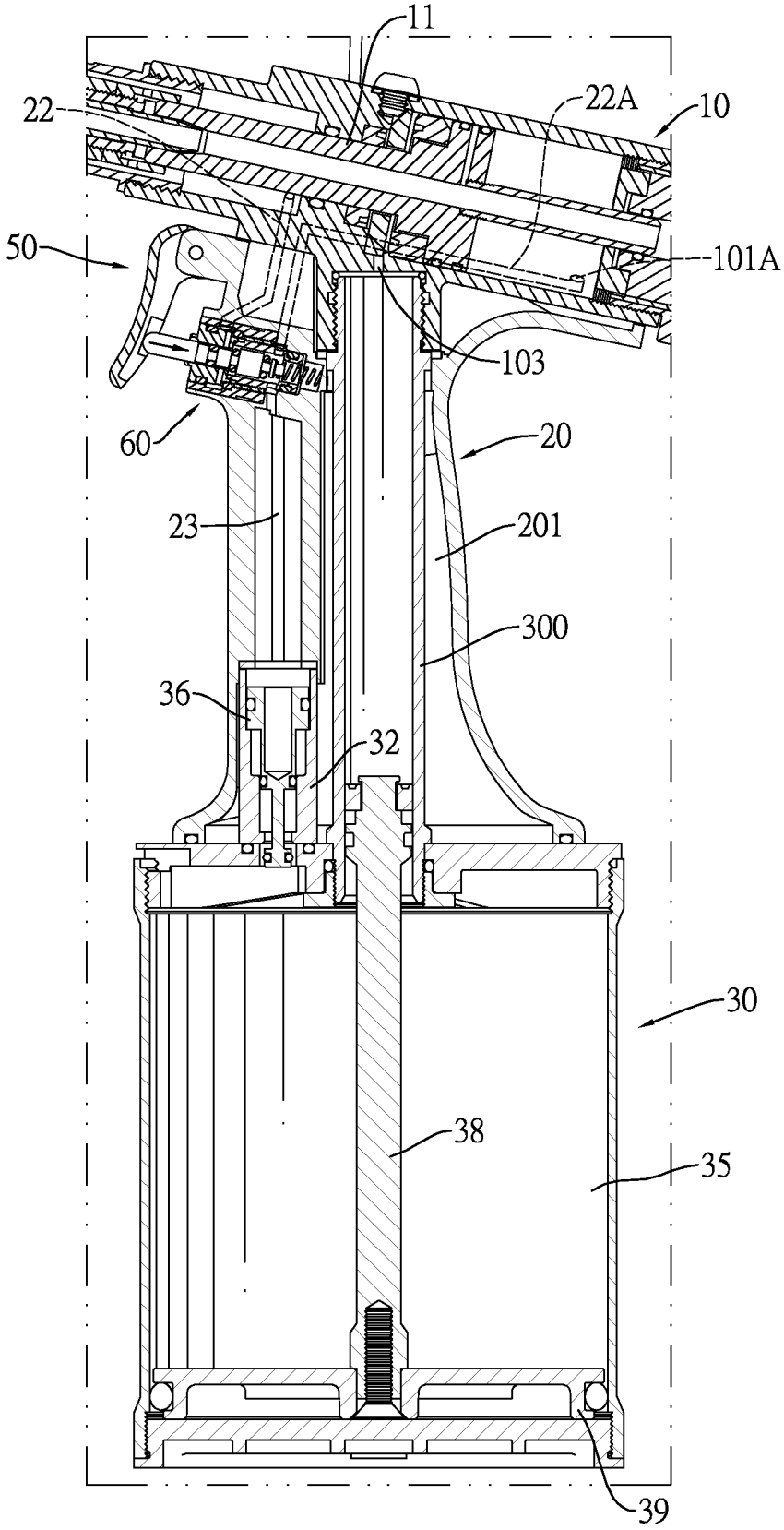
FIG. 3B is an enlarged cross sectional side view of the rivet gun in FIG. 3A.
Figure 3C:
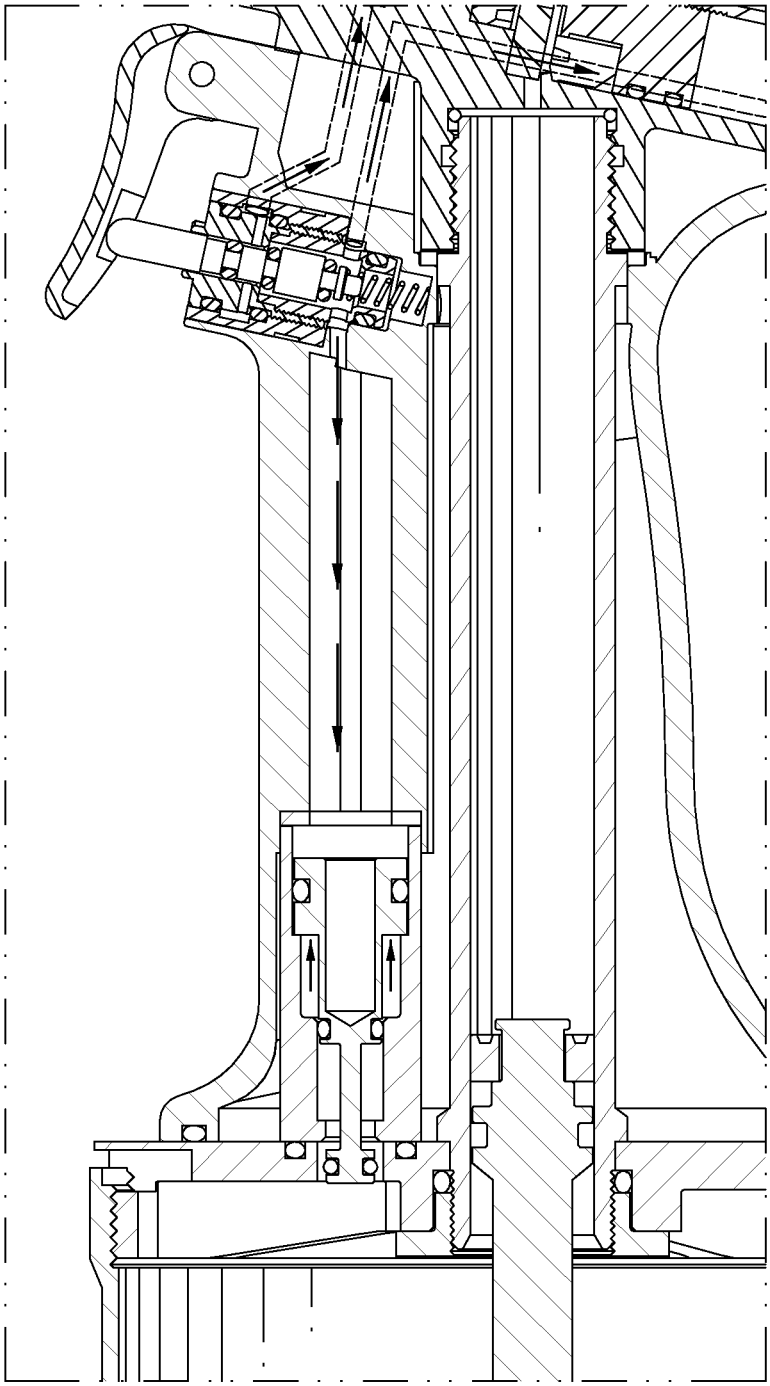
FIG. 3C is a further enlarged cross sectional side view aimed at the handle of the rivet gun in FIG. 3B.
Figure 3D:
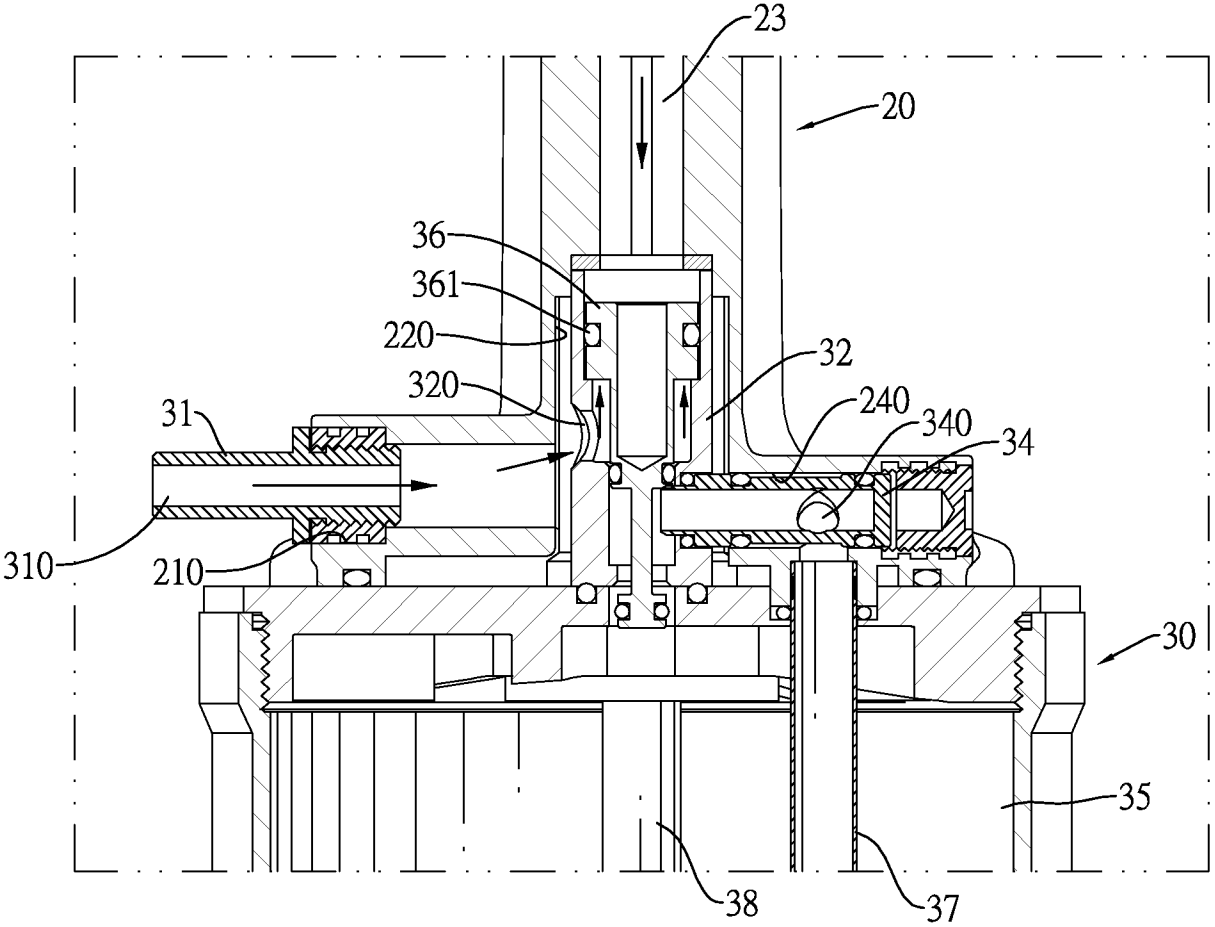
FIG. 3D is a further enlarged cross sectional front view aimed at the bottom of the handle and the top of the pneumatic cylinder of the rivet gun in FIG. 3B.
Figure 3E:
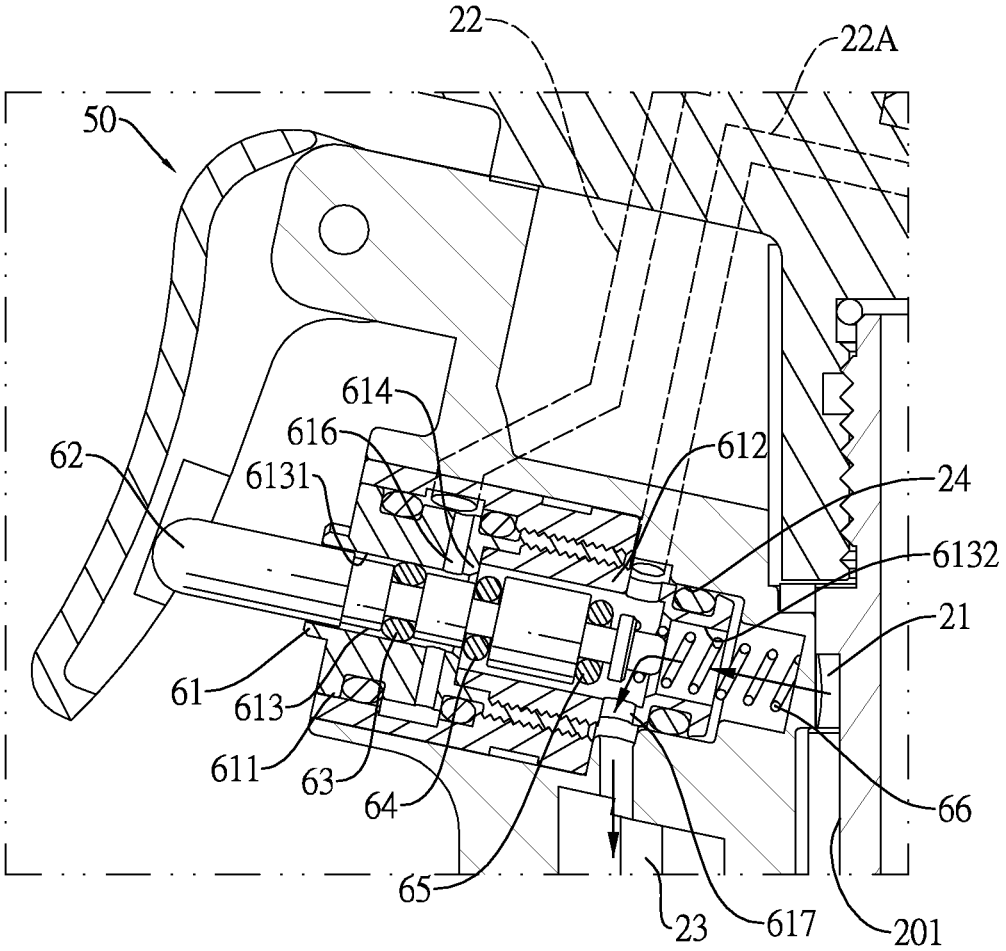
FIG. 3E is a further enlarged cross sectional side view further aimed at the trigger device of the rivet gun in FIG. 3D.
Figure 4A:
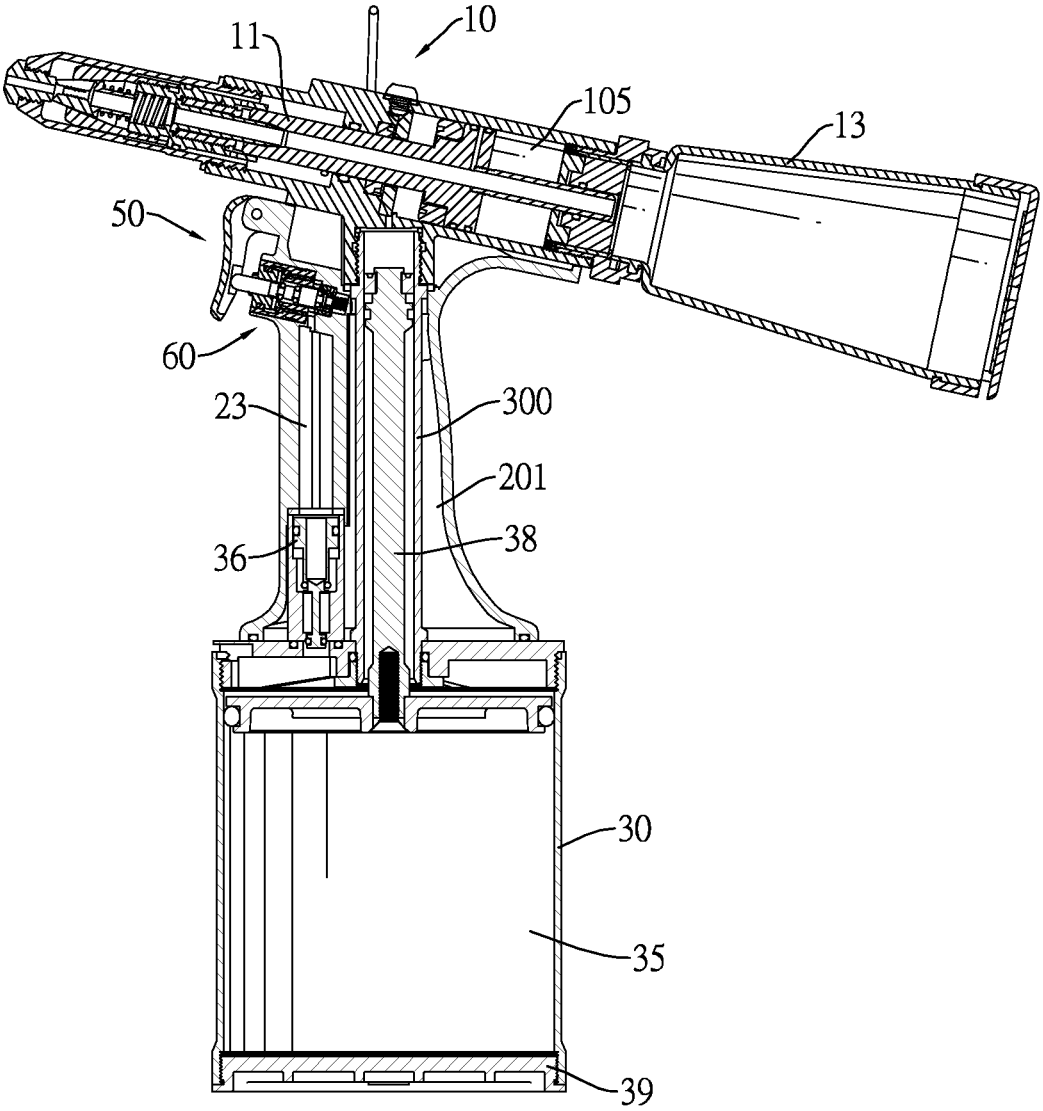
FIG. 4A is a cross sectional side view of the rivet gun in FIG. 1A, wherein the trigger device is triggered to a second step.
Figure 4B:
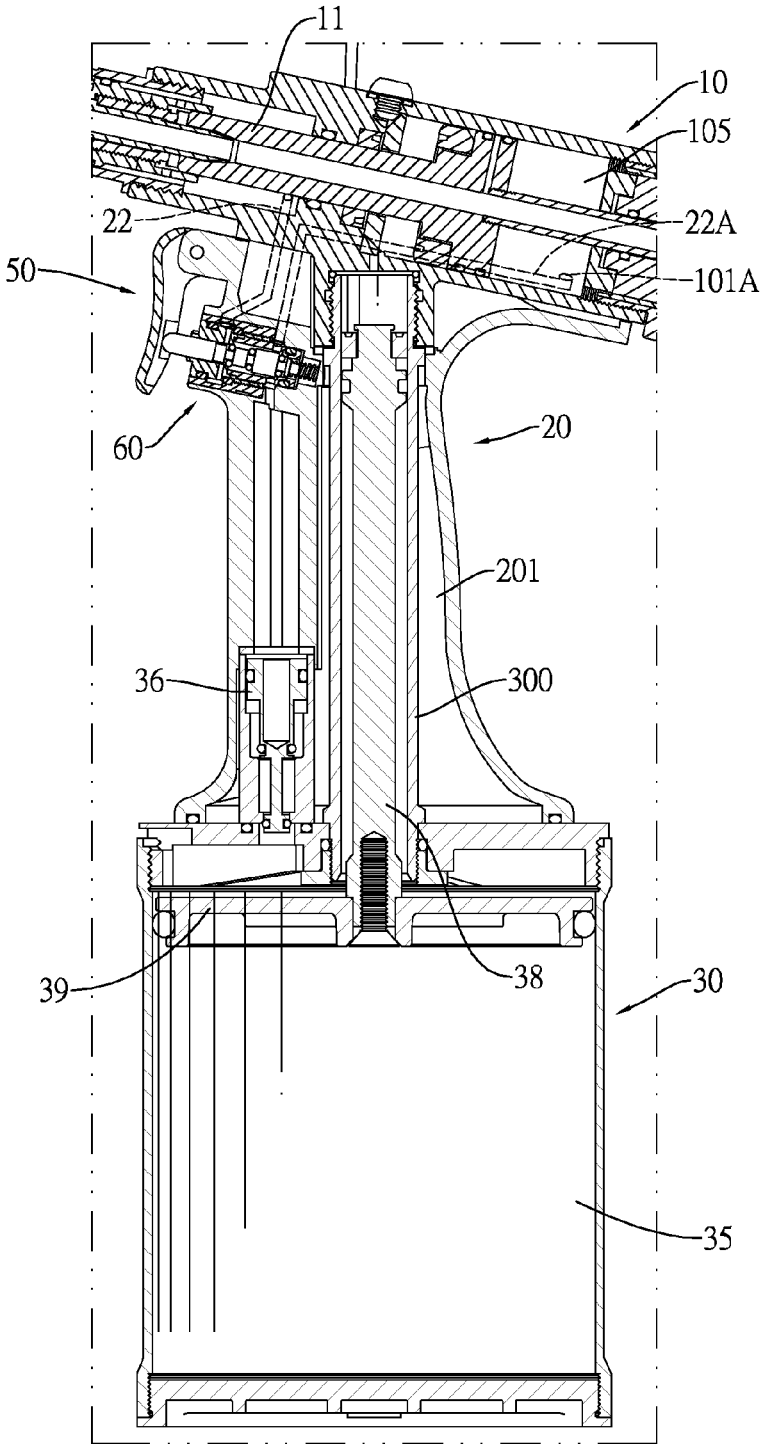
FIG. 4B is an enlarged cross sectional side view of the rivet gun in FIG. 4A.
Figure 4C:
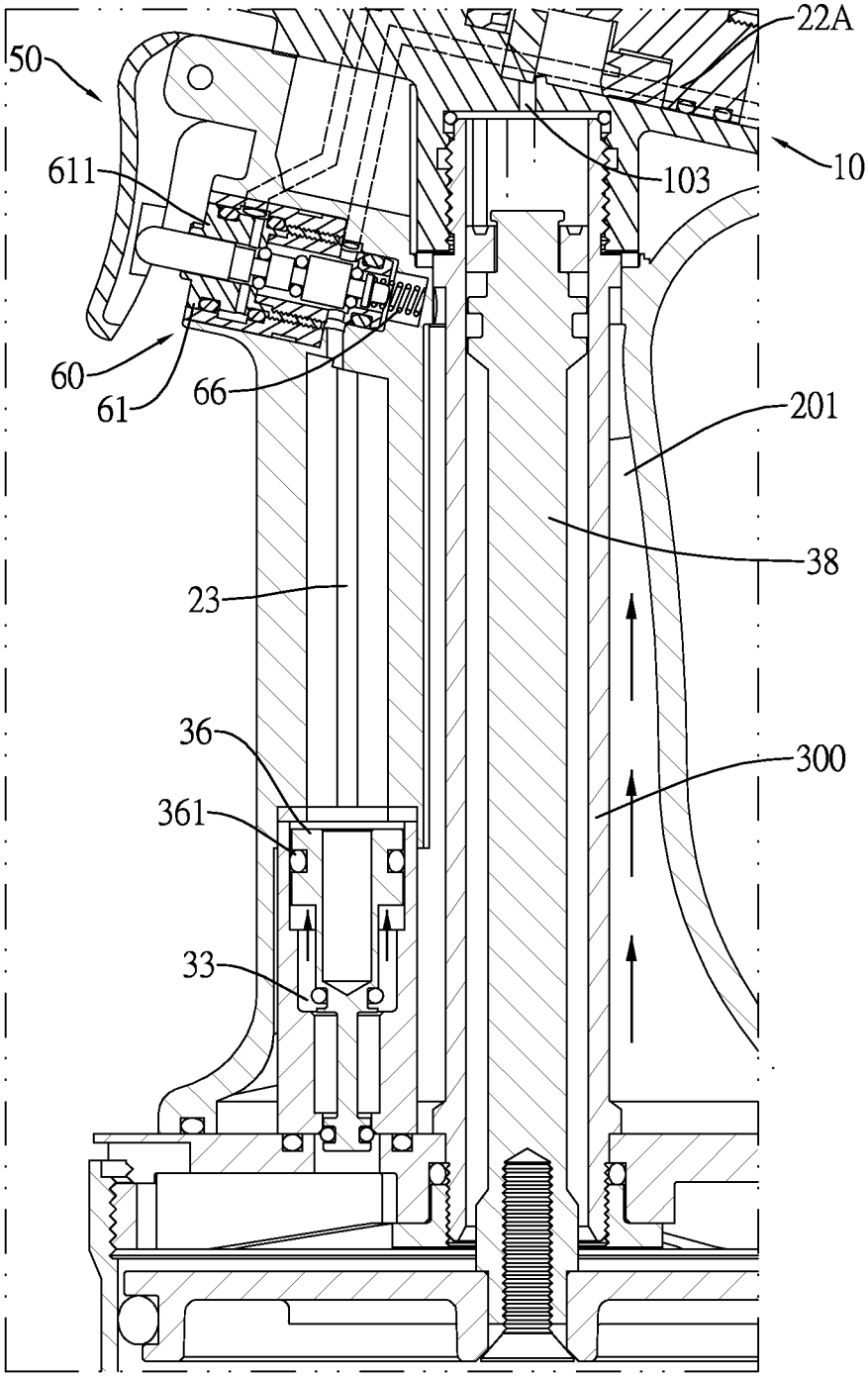
FIG. 4C is a further enlarged cross sectional side view aimed at the handle of the rivet gun in FIG. 4B.
Figure 4D:
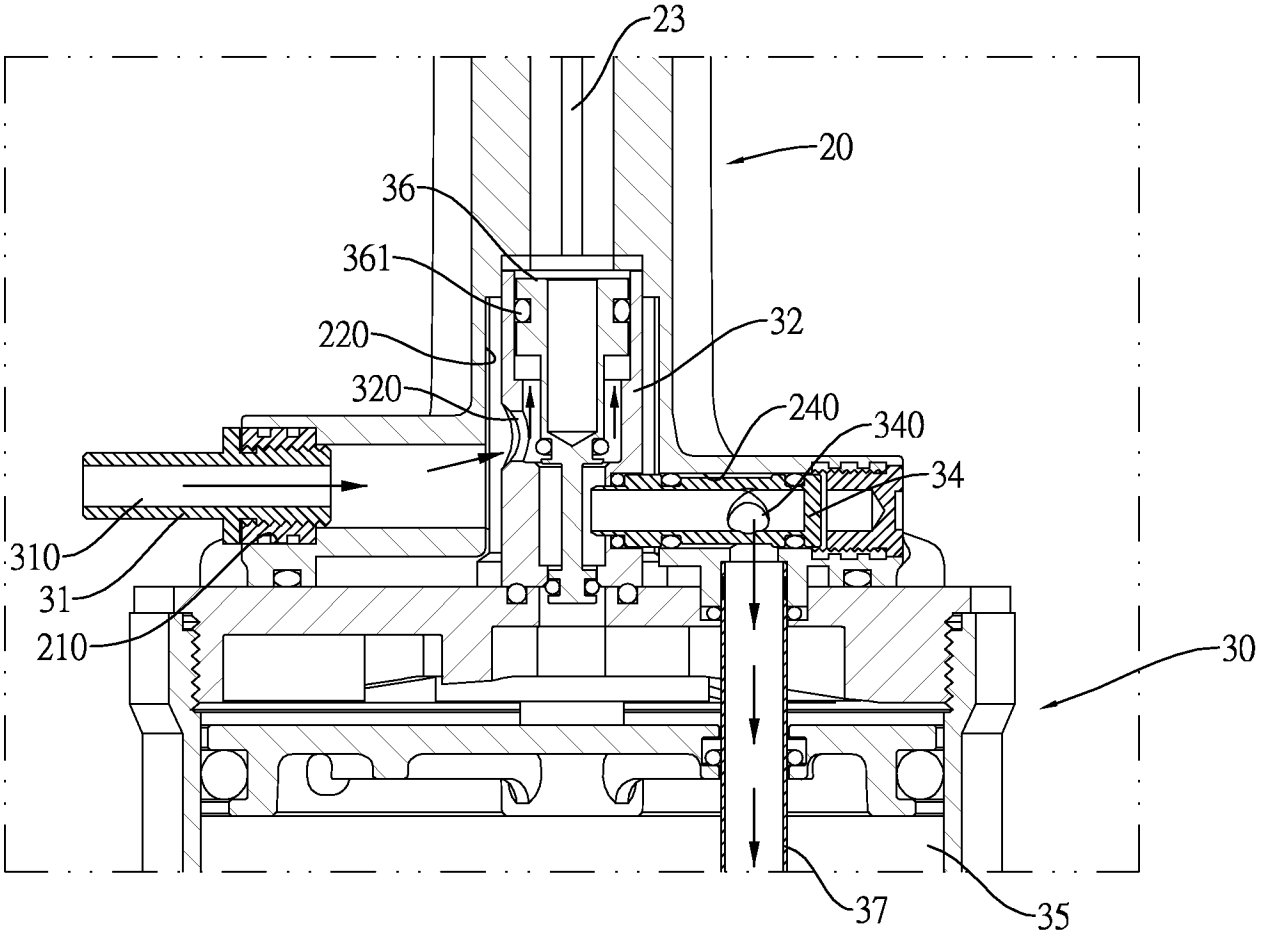
FIG. 4D is a further enlarged cross sectional front view aimed at the bottom of the handle and the top of the pneumatic cylinder of the rivet gun in FIG. 4B.
Figure 4E:
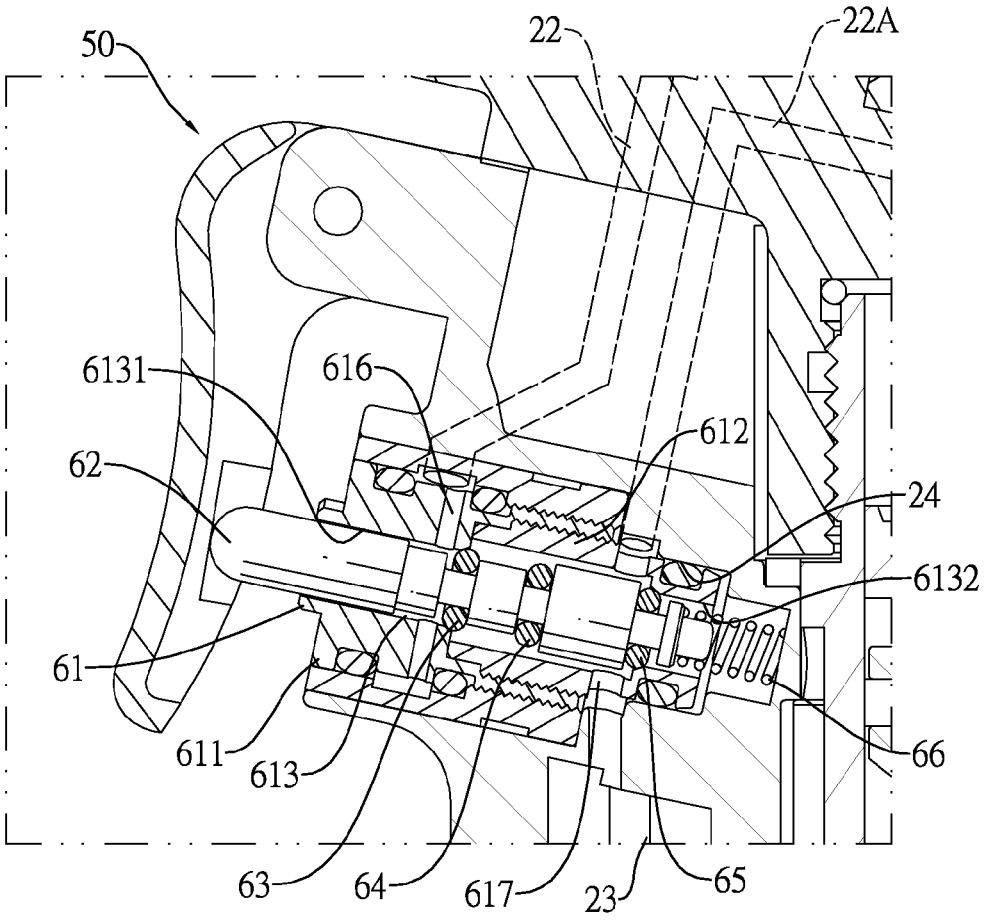
FIG. 4E is a further enlarged cross sectional side view further aimed at the trigger device of the rivet gun in FIG. 4D.

With further reference to FIGS. 2C, 2E, the handle (20) is mounted perpendicularly on the bottom of the barrel (10) and has a top end, a bottom end, a central hole (201), an inlet channel (21), an outlet channel (22), a pressurizing channel (22A), a valve-driving channel (23), and a space (24) (as shown in FIG. 2E).

The central hole (201) is defined through the handle (20).

The inlet channel (21) is defined in the handle (20) and communicates with the central hole (201).

The outlet channel (22) is defined through the handle (20) and communicates with the outlet hole (101) of the barrel (10).

The pressurizing channel (22A) is defined in the handle (20) adjacent the top end and communicates indirectly with the central hole (201).

The valve-driving channel (23) is defined through the handle (20).

The space (24) is defined in one side of the handle (20) and communicates with the inlet channel (21), outlet channel (22), pressurizing channel (22A) and valve-driving channel (23).

In a preferred embodiment, the handle (20) further has a valve-mounting hole (220), a first mounting hole (210) and a second mounting hole (240). The valve-mounting hole (220) is defined in the bottom end and is located centrically and communicates with the central hole (201). The first mounting hole (210) is defined in the bottom end of the handle (20) along a radial direction relative to the central hole (201). The second mounting hole (240) is defined in the bottom end of the handle (20) along the radial direction relative to the central hole (201). The first and second mounting holes (210, 240) are simply cylindrical so that a mold used to insert-mold the handle (20) is structurally simplified to lower the cost of the mold and raise the production rate of the handle (20).

The pneumatic cylinder (30) is mounted on the bottom end of the handle (20), communicates with the valve-driving channel (23) and has a top, a bottom, an inlet bushing (31), an inner bushing (34), a control valve assembly, a chamber (35), a hydraulic tube (300), a piston (38), a head disk (39) and a pipe (37).

The inlet bushing (31) is hollow and cylindrical, is mounted in the first mounting hole (210) and has an inlet passageway (310) defined through the inlet bushing (31).

The inner bushing (34) is hollow and cylindrical, is mounted in the second mounting hole (240) and has an open end and a lower passageway (340) defined in the inner bushing (34) and communicating with the open end.

The control valve assembly is mounted in the valve-mounting hole (220) and has a casing (32) and a valve shaft (36).

The casing (32) is cylindrical, is mounted in the valve-mounting hole (220) and has an internal cavity (33), a bypass passageway (320) and a lateral hole. The internal cavity (33) is defined in the casing (32) and communicates with the valve-driving channel (23) and has an inner surface. The bypass passageway (320) is defined radially through the casing (32) and communicates with the inlet passageway (310) and the internal cavity (33). The lateral hole is defined radially through the casing (32) so that the open end of the inner bushing (34) is inserted in the lateral hole to make the internal cavity (33) communicate with the lower passageway (340).

The valve shaft (36) is mounted slidably up and down in the internal cavity (33) and selectively hermetically isolates the internal cavity (33) from the lower passageway (340). The valve shaft (36) has a sealing ring (361) mounted around the valve shaft (36), hermetically contacting the inner surface of the internal cavity (33) and dividing the internal cavity (33) into an upper cavity and a lower cavity.

The chamber (35) is defined in the pneumatic cylinder (30), communicates with the lower passageway (340) and has an inner surface.

The hydraulic tube (300) is hollow, is mounted in the central hole (201), communicates with the hydraulic passageway (103) and may receive liquid such as water or oil.

The piston (38) is mounted hermetically and slidably in the hydraulic tube (300) and extends into the chamber (35). Moving up the piston (38) squeezes the liquid from the hydraulic tube (300) through the hydraulic passageway (103) into the barrel (10) to drive the vise assembly (11) to pull the core pin backward.

The head disk (39) is mounted securely on the piston (38), is mounted slidably in the chamber (35), hermetically contacts the inner surface of the chamber (35) and divides the chamber (35) into an upper chamber and a lower chamber.

The pipe (37) is mounted in the lower passageway (340), extends into the lower chamber of the chamber (35) and is mounted slidably through the head disk (39). The high-pressure air from a high-pressure air source connected to the inlet passageway (310) may flow through the pipe (37) to the lower chamber to lift up the head disk (39).

The trigger member (50) is mounted pivotally on the handle (20) and is located opposite to the space (24).

The two-step pressing assembly (60) is mounted securely in the space (24) of the handle (20) to form a rivet gun handle assembly, is selectively activated by the trigger member (50), selectively communicates with the inlet channel (21), the pressurizing channel (22A) and communicates permanently with the valve-driving channel (23). The two-step pressing assembly (60) has a tube assembly (61), a control shaft (62), a front sealing ring (64), a rear sealing ring (65) and a spring (66) and may further have an outside sealing ring (63).

The tube assembly (61) may be assembled by a front sleeve (611) and a rear sleeve (612), is mounted in the space (24) and has a mounting hole (613), an outlet bore (616), a valve bore (617), a front shoulder (614) and a rear shoulder (615). The rear sleeve (612) is mounted securely in the front sleeve (611) by an inner thread and an outer thread formed respectively on the front and rear sleeves (611, 612) and engaged with each other. The mounting hole (613) is defined axially through the tube assembly (61), may be defined through the front sleeve (611) and the rear sleeve (612) and has a front open end (6131), a rear open end (6132) and an inner surface. The outlet bore (616) is defined radially in the tube assembly (61), may be defined in the front sleeve (611) and communicates with the mounting hole (613) and the outlet channel (22). The valve bore (617) is defined radially in the tube assembly (61), may be defined in the rear sleeve (612) and communicates with the mounting hole (613), the valve-driving channel (23) and the pressurizing channel (22A). The front shoulder (614) is annular, is formed on and radially protrudes inward from the inner surface of the mounting hole (613) of the tube assembly (61) and may protrude from the front sleeve (611). The rear shoulder (615) is annular, is formed on and radially protrudes inward from the inner surface of mounting hole (613) of the tube assembly (61) and may protrude from the rear sleeve (612). Furthermore, the outlet bore (616) may be located between the front open end (6131) of the mounting hole (613) and the front shoulder (614). The valve bore (617) is located between the front and rear shoulders (614, 615).

The control shaft (62) is mounted slidably in the mounting hole (613) and has a front end and a rear end. The front end of the control shaft (62) protrudes out of the front open end (6131) and is selectively pressed by the trigger member (50).

The front sealing ring (64) is mounted around the control shaft (62) and selectively contacts the front shoulder (614) hermetically to isolate the rear open end (6132) from the outlet bore (616) and the pressurizing channel (22A).

The rear sealing ring (65) is mounted around the control shaft (62) and selectively contacts the rear shoulder (615) hermetically to isolate the rear open end (6132) from the valve bore (617) and the valve-driving channel (23).

The outside sealing ring (63) is mounted around the control shaft (62) between the front end and the front sealing ring (64) and hermetically contacts the inner surface of the mounting hole (613) to prevent inside air from leaking out of the handle (20).

The spring (66) extends through the rear open end (6132) into the mounting hole (613), is mounted between the control shaft (62) and the inner surface of the space (24) to bias the control shaft (62) at a protruding position making the front sealing ring (64) hermetically abut the front shoulder (614) to block the outlet bore (616).

The operation of the rivet gun has three acts as follows.

1. First act: With reference to FIGS. 2A to 2E, when the trigger member (50) is not pulled, the outlet bore (616) is sealed to prevent the high-pressure air of the high-pressure air source from flowing into the barrel (10) to pull the core pin. However, the high-pressure air still flows in turn through the inlet passageway (310) and the central hole (201). Then the high-pressure air flows into the inlet channel (21) and the bypass passageway (320) simultaneously. The air into the inlet channel (21) flows in turn through the valve bore (617), the valve-driving channel (23) and the upper cavity of the internal cavity (33). The air into the bypass passageway (320) further flows into to the lower cavity of the internal cavity (33). The air in the lower cavity and air in the upper cavity have same pressure so that the valve shaft (36) would not move and stays stably at a lower position to hermetically isolate the lower passageway (340) from the internal cavity (33). Furthermore, the air passing through the valve bore (617) also flows into the pressurizing channel (22A) and enters the condensable chamber (105) behind the vise assembly (11) in the barrel (10) to maintain the vise assembly (11) in a front position.

2. Second act: With reference to FIGS. 1A, 1B and 3A to 3E, when the trigger member (50) is pulled halfway at a first step, the control shaft (62) moves toward the rear open end (6132) of the mounting hole (613) of the tube assembly (61). The front sealing ring (64) separates from the front shoulder (614) to allow the outlet bore (616) to communicate with the rear open end (6132) of the mounting hole (613). The high-pressure air flows in turn through the inlet passageway (310), the central hole (201), the inlet channel (21), the outlet channel (22), the outlet bore (616) and finally into the barrel (10) to eject the core pin out of the barrel (10) into the collector (13). Also, the high-pressure air flows in turn through the valve bore (617), the valve-driving channel (23) and the upper cavity of the internal cavity (33). The upper and lower cavities of the internal cavity (33) have the same air pressure so that the valve shaft (36) still stays stably at the lower position to hermetically isolate the lower passageway (340) from the internal cavity (33). Furthermore, the air passing through the valve bore (617) still flows into the pressurizing channel (22A) and enters the condensable chamber (105) behind the vise assembly (11) in the barrel (10) to push and maintain the vise assembly (11) in a front position by sufficient pressure.

3. Third act: With reference to FIGS. 4A to 4E, when the trigger member (50) is further pulled completely, the rear sealing ring (65) hermetically contacts the rear shoulder (615) to isolate the valve bore (617) from the rear open end (6132) of the mounting hole (613) and to isolate the outlet bore (616) from the rear open end (6132) of the mounting hole (613). Therefore, the air from the high-pressure air source cannot flow into the valve-driving channel (23) through the inlet channel (21). The air of the high-pressure air source flows in turn through the inlet passageway (310), the bypass passageway (320) and the lower cavity of the internal cavity (33). The air pressure of the lower cavity is the same as that of the high-pressure air source and is larger than that of the upper cavity so that the valve shaft (36) is moved upwards to allow the lower passageway (340) to communicate with the internal cavity (33). The high-pressure air then flows from the internal cavity (33) into the lower chamber of the chamber (35) to drive the head disk (39) and the piston (38) to move upwards. Then the pneumatic cylinder (30) drives the vise assembly in the barrel (10) to pull the core pin. Furthermore, the air passing through the valve bore (617) does not flow into the pressurizing channel (22A) and the condensable chamber (105) so that the vise assembly (11) moves backward and condenses the condensable chamber (105). When the trigger device is released, high-pressure air flows into the condensable chamber (105) again and expands the condensable chamber (105) to move the vise assembly (11) to the original front position.

The rivet gun of the present invention has the following advantages.

1. The rivet gun outputs the air of the high-pressure air source only when the trigger device is pulled completely at the second step. Therefore, the rivet gun with the trigger device saves the high-pressure air and prevents the noise caused by the air that is being continuously outputted.

2. The condensable chamber (105) functions as a recoiling spring to allow the vise assembly (11) to move to the original front position after the trigger device is released. Therefore, the barrel (10) needs no physical spring mounted therein.

3. The valve-mounting hole (220), first mounting hole (210) and second mounting hole (240) of the handle (20) are substantially cylindrical instead of having a more complicated shape so that manufacturing the handle (20) by insert-molding processes is easier, the production rate of the handle (20) is high and the manufacturing cost is low. The inlet bushing (31), inner bushing (34) and casing (32) of the control valve assembly corresponding respectively to aforementioned holes are also cylindrical and mounted detachably therein. Therefore, the inlet bushing (31), inner bushing (34) and casing (32) may be replaced if necessary for different applications or maintenance.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A rivet gun comprising:

a barrel;

a handle mounted perpendicularly on a bottom of the barrel and having a top end, a bottom end, a central hole defined through the handle, an inlet channel defined in the handle and communicating with the central hole, an outlet channel defined through the handle, a valve-driving channel defined through the handle, and a space defined in the handle and communicating with the inlet channel and the valve-driving channel;

a pneumatic cylinder mounted on the bottom end of the handle and communicating with the valve-driving channel;

a trigger member mounted pivotally on the handle; and a two-step pressing assembly mounted securely in the space of the handle to form a rivet gun handle assembly, selectively activated by the trigger member, selectively communicating with the inlet channel and communicating permanently with the valve-driving channel;

the rivet gun characterized in that:

the barrel is hollow and has a through hole defined axially through the barrel;

an outlet hole defined transversely through the barrel and communicating with the through hole and the outlet channel of the handle;

a pressurizing hole defined transversely through the barrel, located behind the outlet hole and communicating with the through hole;

a hydraulic passageway defined through the bottom of the barrel and communicating with the through hole;

a vise assembly mounted in the through hole and having a front end and a rear end; and a condensable chamber defined in the barrel and located behind the rear end of the vise assembly;

the handle further has a valve-mounting hole defined in the bottom end of the handle and located centrically and communicating with the central hole;

a first mounting hole defined in the bottom end of the handle along a radial direction relative to the central hole; and a second mounting hole defined in the bottom end of the handle along the radial direction relative to the central hole;

a pressurizing channel defined in the handle adjacent to the top end, communicating with the central hole, the condensable chamber and the space and selectively communicating with the two-step pressing assembly; and the pneumatic cylinder has a top;

a bottom;

an inlet bushing being hollow and cylindrical, mounted in the first mounting hole and having an inlet passageway defined through the inlet bushing;

an inner bushing being hollow and cylindrical, mounted in the second mounting hole and having an open end and a lower passageway defined in the inner bushing and communicating with the open end;

a control valve assembly mounted in the valve-mounting hole;

a chamber defined in the pneumatic cylinder, communicating with the lower passageway and having an inner surface; and a hydraulic tube being hollow, mounted in the central hole and communicating with the hydraulic passageway.

2. The rivet gun as claimed in claim 1, wherein the two-step pressing assembly has a tube assembly mounted in the space and having a mounting hole defined axially through the tube assembly and having a front open end, a rear open end and an inner surface;

an outlet bore defined radially in the tube assembly and communicating with the mounting hole and the outlet channel;

a valve bore defined radially in the tube assembly and communicating with the mounting hole, the valve-driving channel and the pressurizing channel;

a front shoulder being annular, formed on and radially protruding inward from the inner surface of the mounting hole of the tube assembly; and a rear shoulder being annular, formed on and radially protruding inward from the inner surface of the mounting hole of the tube assembly;

a control shaft mounted slidably in the mounting hole and having a front end and a rear end, wherein the front end of the control shaft protrudes out of the front open end and is selectively pressed by the trigger member;

a front sealing ring mounted around the control shaft and selectively contacting the front shoulder hermetically to isolate the rear open end from the outlet bore and the pressurizing channel;

a rear sealing ring mounted around the control shaft and selectively contacting the rear shoulder hermetically to isolate the rear open end from the valve bore and the valve-driving channel; and a spring extending through the rear open end into the mounting hole, mounted between the control shaft and the inner surface of the space to bias the control shaft at a protruding position making the front sealing ring hermetically abut the front shoulder to block the outlet bore.

3. The rivet gun as claimed in claim 2, wherein the outlet bore is located between the front open end of the mounting hole and the front shoulder; and the valve bore is located between the front and rear shoulders.

4. The rivet gun as claimed in claim 3, wherein the tube assembly is assembled by a front sleeve and a rear sleeve.

5. The rivet gun as claimed in claim 4, wherein the rear sleeve is mounted securely in the front sleeve by an inner thread and an outer thread formed respectively on the front and rear sleeves and engaged with each other.

6. The rivet gun as claimed in claim 5, wherein the outlet bore is defined in the front sleeve and the front shoulder protrudes from the front sleeve; and the rear shoulder protrudes from the rear sleeve and the valve bore is defined in the rear sleeve.

7. The rivet gun as claimed in claim 6, wherein an outside sealing ring is mounted around the control shaft between the front end and the front sealing ring and hermetically contacts the inner surface of the mounting hole.

8. The rivet gun as claimed in claim 7, wherein the control valve assembly has a casing being cylindrical, mounted in the valve-mounting hole and having an internal cavity defined in the casing, communicating with the valve-driving channel and having an inner surface;

a bypass passageway defined radially through the casing and communicating with the inlet passageway and the internal cavity;

a lateral hole defined radially through the casing so that the open end of the inner bushing is inserted in the lateral hole to make the internal cavity communicate with the lower passageway; and a valve shaft mounted slidably up and down in the internal cavity, selectively hermetically isolating the internal cavity from the lower passageway and having a sealing ring mounted around the valve shaft, hermetically contacting the inner surface of the internal cavity and dividing the internal cavity into an upper cavity and a lower cavity.

* * * * *